US009151144B2

(12) United States Patent
Ibatullin et al.

(10) Patent No.: US 9,151,144 B2
(45) Date of Patent: Oct. 6, 2015

(54) EXPANDABLE SAND SCREEN AND METHOD FOR WELL CASING FOR THERMAL OIL RECOVERY

(71) Applicant: Otkrytoe aktsionernoe obschestvo "Tatneft" im. V.D. Shashina, Almetievsk (RU)

(72) Inventors: Ravil Rustamovich Ibatullin, Bugulma (RU); Gabdrashit Sultanovich Abdrakhmanov, Moscow (RU); Marat Marsovich Zalyatov, Almetievsky (RU); Anatoly Valentinovich Dimitriev, Almetievsk (RU); Nigamatyan Khamitovich Khamitiyanov, Bugulma (RU); Farit Foatovich Akhmadishin, Aznakaevo (RU); Rustam Khisamovich Ilalov, Bugulma (RU); Marat Gafurovich Sabirov, Aznakaevo (RU); Vitaly Petrovich Filippov, Bugulma (RU); Marat Azatovich Ismagilov, Bugulma (RU)

(73) Assignee: Otkrytoe Aktsionernoe Obschestvo "Tatneft" IM. V. D.Shashina, Almetievsk (RU)

( * ) Notice: Subject to any disclaimer, the term of this patent is extended or adjusted under 35 U.S.C. 154(b) by 434 days.

(21) Appl. No.: 13/687,281

(22) Filed: Nov. 28, 2012

(65) Prior Publication Data

US 2013/0327526 A1 Dec. 12, 2013

(30) Foreign Application Priority Data

Nov. 28, 2011 (RU) ..... 2011148404

(51) Int. Cl.
*E21B 43/08* (2006.01)
*E21B 43/10* (2006.01)

(52) U.S. Cl.
CPC ..... *E21B 43/08* (2013.01); *E21B 43/086* (2013.01); *E21B 43/108* (2013.01)

(58) Field of Classification Search
CPC ..... E21B 43/08
See application file for complete search history.

(56) References Cited

U.S. PATENT DOCUMENTS 3,353,599 A * 11/1967 Swift ..... 166/278
5,287,923 A * 2/1994 Cornette et al. ..... 166/278

(Continued)

FOREIGN PATENT DOCUMENTS

RU 2197600 C2 1/2003
RU 2 421 603 C1 2/2010

OTHER PUBLICATIONS

English translation of 2197600 C2 claims.

(Continued)

*Primary Examiner* — John Kreck
(74) *Attorney, Agent, or Firm* — Ladas & Parry LLP

(57) ABSTRACT

A method of well casing permitting thermal oil recovery includes drilling a wellbore to the top of productive formation, casing the wellbore with a casing string, drilling through the productive with a smaller diameter bit, running in a sand screen to the productive formation and subsequent drainage or heat carrier injection into the formation. The sand screen contains longitudinally-corrugated pipes with slots, mutually connected by the end cylindrical portions with a limited longitudinal shift possibility. Besides, the sand screen slots are internally hermetically sealed with a thermoplastic material. Running-in of the screen down to the target depth, include creating an internal excess pressure to expand the sand screen along its entire length except for cylindrical sections, fixing and hermetical anchoring to the casing. Pumping-in of a heat-carrier, under influence of which the thermoplastic material melts up, unseals the slots.

4 Claims, 2 Drawing Sheets

(56) References Cited

U.S. PATENT DOCUMENTS

| | | | | |
|---|---|---|---|---|
| 6,073,692 | A * | 6/2000 | Wood et al. | 166/187 |
| 2003/0075333 | A1* | 4/2003 | Vercaemer et al. | 166/308 |
| 2005/0065037 | A1* | 3/2005 | Constien | 507/203 |
| 2005/0109517 | A1* | 5/2005 | Spray | 166/380 |
| 2007/0089886 | A1* | 4/2007 | Orban et al. | 166/382 |

OTHER PUBLICATIONS

English translation of 2 421 603 C1 Abstract and claim.

* cited by examiner

EXPANDABLE SAND SCREEN AND METHOD FOR WELL CASING FOR THERMAL OIL RECOVERY

The invention relates to the oil industry, in particular, may be used in the construction and operation of oil wells with application of thermal oil methods.

It is known from the art an "Expandable Sand Screen" (RU 2197600 C2), comprising an expandable supporting pipe slotted carrier tube, coaxially with which a number of filter sheets is installed in form of iris diaphragm, so that due to the pipe expansion an overlap value between the adjacent filter sheets decreases, and the filter sheets include elongated bands with staggered rows of slots, located transversely to the longitudinal axis of every band; the slots are located so that the alternating rows are displaced up to the half of the slots' pitch in transverse direction; the length of the slots is larger than half of their transverse pitch, and such layout of the slots is maintained along longitudinal edge of every band; besides, every band is fixed on the expandable slotted carrier tube in lengthwise located mutually equidistantly located fixation points, and said fixation points are positioned in the junctions between the ends of the carrier tube slots; moreover, longitudinal axis of the every band is generally parallel to the central axis of the carrier tube, both before and after an expansion.

A method of well casing including running-in of the expandable sand screen (see above) to the installation interval, and expanding the carrier tube with an expansion cone, so that overlapping adjacent filter sheets slide relative to each other and are forced against the wellbore wall.

The disadvantages of the method and the expandable sand screen are as follows:

- impossibility of using the sand screen in wells for well casing during thermal oil recovery, since no temperature deformation compensating device is provided;
- risk of filter sheets tearing during the sand screen running-in to the installation interval;
- risk of a partial rock falling in the bottomhole zone of the productive formation, since overlapping of filter sheets still remains, and the sheets are not tightly forced against the rock after carrier tube expansion;
- risk of blocking the slots in the filter sheets by the carrier tube sections without the slots, and vice versa, which reduces filtration ability of the sand screen;
- need for an expansion cone resulting in additional material costs;
- complexity of manufacturing and, consequently, high material costs.

The closest technical solution is the "Expandable Sand Screen" (RU 2421603 C1). This expandable sand screen comprises an integral carrier tube with transverse slots, expanded by an expansion cone and including an anchor in the form of a longitudinally-corrugated pipe with hermetically attached expansion cone in its upper part, connected to a casing string and provided with a fishing tool; and, between the carrier tube and the anchor a retrievable bypass valve installed with a fishneck in the upper part for the fishing tool.

The method, implemented by means of this sand screen, comprises drilling a wellbore to the top of productive formation, casing the wellbore with a casing string, drilling through the productive formation with a smaller diameter bit, running-in the sand screen to the productive formation, creating an excess pressure to fix the sand screen and tightly connect it by the anchor with the main hole casing, and subsequent drainage or heat-carrier injection into the formation through the sand screen.

The disadvantages of the method and the expandable sand screen are as follows:

- impossibility of using the sand screen in wells for well casing when thermal oil recovery methods are used since no temperature deformation compensating device is provided;
- necessity of expanding the carrier tube with an expansion cone, resulting in additional costs.

The technical purpose of the alleged invention is the development of a method and a simple, reliable expandable sand screen, allowing for well casing for the thermal oil recovery, as well as for reducing sand screen installation and operation cost.

Said technical purposes are solved by the well casing method for thermal oil recovery, implemented by means of the expandable sand screen, including drilling a wellbore to the top of productive formation, casing the wellbore with a casing string, formation drilling through the productive formation with a smaller diameter bit, running-in the sand screen to the productive formation, creating an excess pressure to fix the sand screen and tightly connect it by the anchor with the main hole casing, and subsequent drainage or heat-carrier injection into the formation through the sand screen.

The novelty consists in the fact that said sand screen is pre-assembled of longitudinally-corrugated pipes with slots, mutually connected by the end cylindrical portions with a limited longitudinal shift possibility, and the screen slots are sealed from the inside with a thermoplastic material, and after run-in the sand screen is expanded with an excess pressure along its entire length, except for its cylindrical sections, whereupon a heat carrier is supplied into the sand screen, and thermoplastic material melts, unsealing the slots.

Technical purposes are solved also by the expandable sand screen, including pipes being adapted to provide expansion with the slots, an anchor, installed above the sand screen and accomplished in the form of a longitudinally-corrugated pipe, and a sealing element comprising a shoe with a valve and allowing to create an excess pressure after running down into the well.

The novelty lies in the fact the pipes are longitudinally-corrugated and have cylindrical end sections; the slots on the bulges of the longitudinally-corrugated pipes are hermetically sealed with a thermoplastic material from inside; the sealing element is executed in the form of an end cap installed on the face of the lower pipe of the sand screen; the pipes are connected to each other through a thermal expansion compensator of the sand screen pipes, accomplished in the form of tail pieces, installed on the cylindrical sections of the pipes with a technical collar inbetween and enveloped with a sleeve, one end of which is rigidly connected with the end of one of the pipes, and the other one is connected with the other pipe with a possibility of a limited shift between the stops.

In addition, the tail pieces can be provided with the stoppers, and have cones at the end faces, and may be manufactured of a harder material, than the technical collar material, which is manufactured in such a way it can be compressed by the end face cones of the tail pieces, when thermal elongation of the screen pipes takes place.

Also new is the fact that the technical collar may be provided with an internal circular projection in the middle of its length, and may have cones at the ends; besides, it may be manufactured of the harder material, than the tail pieces material, which are manufactured in such a way they can be compressed by the end cones of the technical collar, when thermal elongation of the sand screen pipes takes place.

Figures 1, 2, 3, 4:
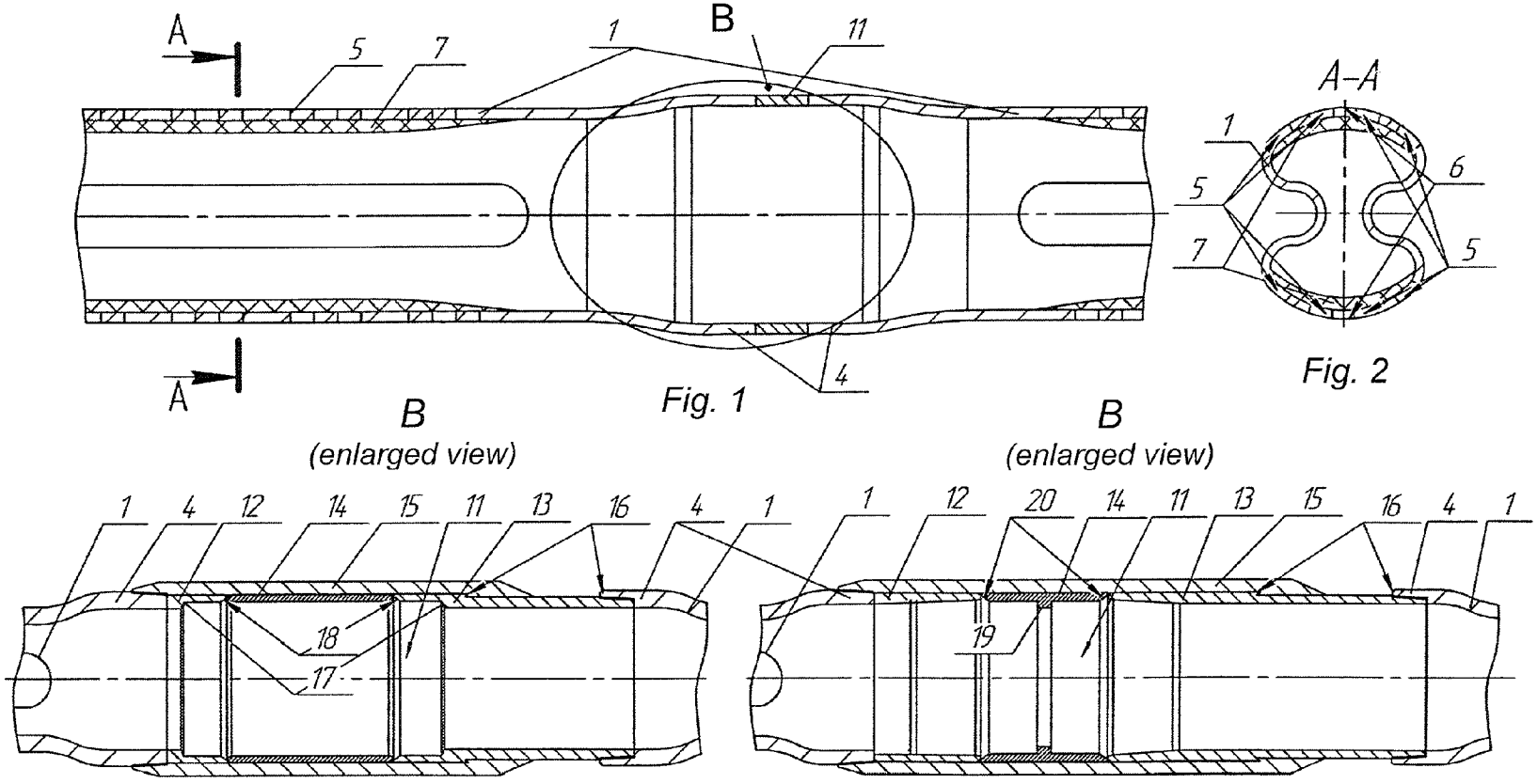
FIG. 1 shows an expandable sand screen (cross-section view) for well casing during thermal oil recovery.
FIG. 2 shows the A-A cross-section of the FIG. 1.
FIG. 3 shows a detail section B of the FIG. 1 (cross-sectional view), sand screen elongation compensator before installation in the wellbore (Embodiment No. 1)
FIG. 4 shows a detail section B of the FIG. 1 (cross-sectional view), sand screen elongation compensator before installation in the wellbore (Embodiment No. 2)
Figure 5:
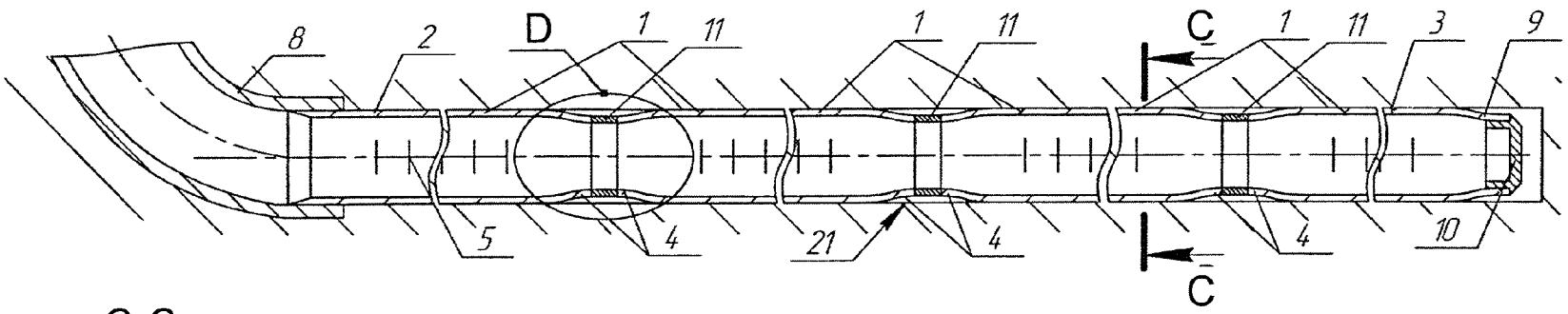
FIG. 5 shows a principle diagram of production formation stabilization with an expandable sand screen with unsealed slots (cross-section view)
Figure 6:
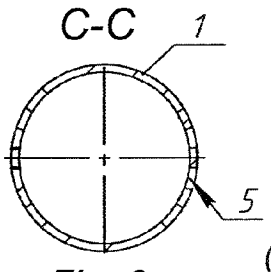
FIG. 6 shows C-C cross-section of the FIG. 5.
Figure 8:
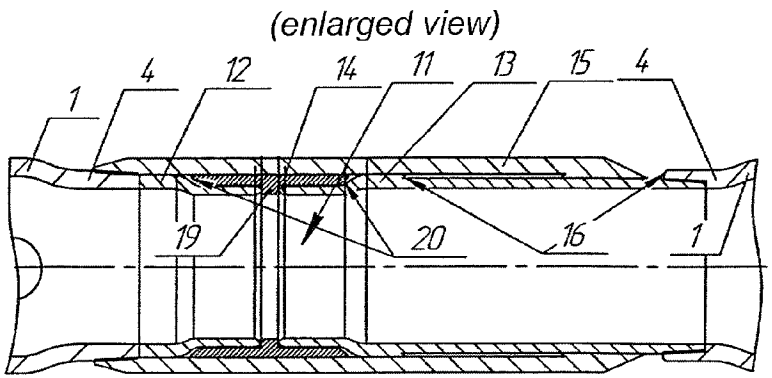
FIG. 8 shows a detail section D of the FIG. 5 (cross-sectional view), sand screen elongation compensator in the process of operation in the wellbore (Embodiment No. 2).
Figure 7:
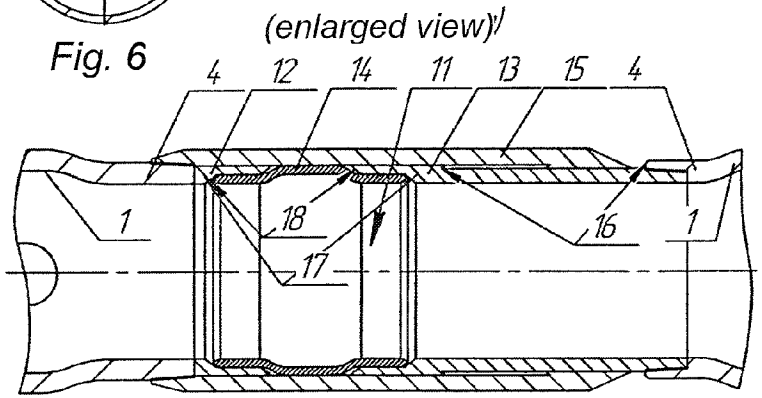
FIG. 7 shows a detail section D of the FIG. 5 (cross-sectional view), sand screen elongation compensator in the process of operation in the wellbore (Embodiment No. 1)

An expandable sand screen comprises the longitudinally-corrugated pipes 1 longitudinally-corrugated pipes being adapted to provide expansion (FIGS. 1-8), 2 (FIG. 5), 3 with cylindrical tail sections 4 (FIGS. 1, 3-5, 7, 8) and the slots 5 (FIGS. 1, 2, 5, 6) in the bulges 6 (FIG. 2) of the pipes 1 (FIGS. 1-8), 2 (FIG. 5), 3, hermetically sealed from inside with a thermoplastic material 7 (FIGS. 1, 2), for instance, with a bituminous mastic (bitumen—95%, machinery oil—5%), polystyrene, polyethylene, etc. An anchor (shown schematically) is connected to the upper pipe 2 (FIG. 5), made, for example, of a longitudinally-corrugated pipe, in order to attach it to a casing 8. On the lower end 9 of the bottom pipe 3 a sealing element 10 is installed, comprising an end cap, for instance, a shoe, a shoe with a valve, etc. The Pipes 1 (FIGS. 1-8), 2 (FIG. 5), 3 of the sand screen are connected among themselves through the thermal elongation compensator (FIGS. 1, 3-5, 7, 8), accomplished in the form of tail pieces 12, 13 (FIGS. 3, 4, 7, 8), located at the cylindrical sections 4 (FIGS. 1, 3-5, 7, 8) with a technical collar 14 (FIGS. 3, 4, 7, 8) installed between them, and externally enveloped by a sleeve 15, one end of which is rigidly connected with the end of one of the pipes 1 (FIGS. 1-8), and the other one is connected with the tail piece 13 of the other pipe 1 (FIGS. 1-8) with a possibility of a limited shift between stops 16 (FIGS. 3, 4, 7, 8). Two possible embodiments of the tail pieces 12, 13 (FIGS. 3, 4, 7, 8) and the technical collars 14 are possible:

Embodiment No. 1: the tail pieces 12 (FIGS. 3, 7), 13 are provided with the stoppers 17 and the cones 18 at the faces, and manufactured from material harder than material of the technical collar 14, which can be compressed by the cones 18 of the tail pieces 12, 13 when thermal elongation of the pipes 1 (FIGS. 1-8) takes place.

Embodiment No. 2: the technical collar 14 (FIGS. 4, 8) is provided with an internal circular projection 19 in the middle of its length, and with cones 20 at the ends, and manufactured of the harder material, than material of the tail pieces 12, 13, which are accomplished in such a way they can be compressed by the end cones 20 of the technical collar 14 when thermal elongation of the sand screen pipes (FIGS. 1-8) takes place.

The thermal elongation compensators 11 (FIGS. 3, 4) factory-assembled. To assemble it, the tail piece 13, the technical collar 14 and the tail piece 12 are successively installed into the sleeve 15. After that, the elongation compensator 11 (FIGS. 3, 4) is screwed-in to the every pipe 1 (FIGS. 1-8), 2 (FIG. 5), 3 from the sleeve 15 side.

The method is realized in the following way:

A well is drilled (not shown), the casing string 8 (FIG. 5) is run-in to the top of productive formation and cemented (not shown), the productive formation is drilled-in with a smaller diameter bit. After that the expandable sand screen of longitudinally-corrugated pipes 1 (FIGS. 1-8), 2 (FIG. 5), 3 is assembled, with installation of the thermal elongation compensators 11 (FIG. 3 or 4) between them. To do so, the longitudinally-corrugated pipe 3 with the end cap 10 on its lower end 9 is run into a hole 21 (FIG. 5) and hung-up on a lifting bail (not shown). The tail piece 13 (FIG. 3 or 4) of the compensator 11 of the next pipe 1 of the sand screen is screwed into the upped end of the pipe 3. The pipes 3 and 1 are run-in and suspended on the lifting bail. In such a way, the sand screen of the required length is assembled. To the last pipe 2 (FIG. 5) an anchor (shown schematically) is connected, made, for example, of a longitudinally-corrugated pipe, in order to attach it to the casing 8. After that, the sand screen is run in to the target depth, expanded by creating an internal excess pressure, and hang-up in the casing by means of an anchor, made, for example, of a longitudinally-corrugated pipe. After that, the sand screen is tightly forced against the wall of the well 21. Then the string of running tools is pulled out of the hole. A heat-carrier is supplied to the well by any known technique, under influence of which the thermoplastic material 7 (FIGS. 1, 2) melts up, unsealing the slots 5 (FIGS. 1, 2, 5, 6). At the same time, due to heating of the pipes 1 (FIGS. 1-8), 2 (FIG. 5) and 3 of the sand screen, their elongation takes place. It brings into action the thermal elongation compensators 11 (FIG. 1, 3-5, 7, 8). Since two possible embodiments of the tail pieces 12, 13 (FIG. 3, 4, 7, 8) and the technical collars 14 are possible, we will consider two possible sand screen operation cases:

Variant Case No. 1:

During thermal extension of the pipes 1 (FIGS. 5, 6, 7), 2 (FIG. 5) and 3, the cylindrical sections 4 (FIGS. 5, 7) push against the tail pieces 12 (FIG. 7), 13, the cones 18 of the tail pieces compress the technical collar 14 inward, overlap it and move until abut against the stoppers 17. The sleeve 15 shifts between the stops 16 for the same distance, as the tailpieces 12, 13. When the heat-carrier injection is stopped, the pipes 1 (FIGS. 5, 6, 7), 2 (FIG. 5), 3 are contracted, the tail pieces 12 (FIG. 7), 13 come out of the technical collar 14, which remains compressed inward. If a heat-carrier is injected again, the tail pieces 12, 13 again enter above the inwardly bent ends of the technical collar 14, thus, preventing the sand screen destruction due to thermal elongation of the pipes 1 (FIGS. 5, 6, 7), 2 (FIG. 5), 3.

Variant Case No. 2:

During thermal extension of pipes 1 (FIGS. 5, 6, 8), 2 (FIG. 5), 3, cylindrical sections 4 (FIGS. 5, 8) push against tail pieces 12 (FIG. 8), 13, which are pushed and bent inwardly by cones 20 of the technical collar 14, overlap it and move until abut against the circular projection 19. The sleeve 15 shifts between the stops 16 for the same distance, as the tailpieces 12, 13. When the heat-carrier injection is stopped, the pipes 1 (FIGS. 5, 6, 8), 2 (FIG. 5), 3 are contracted, the tail pieces 12 (FIG. 7), 13 run off from the technical collar 14, but remain bent inward. If a heat-carrier is injected again, the tail pieces 12, 13 again run on the technical collar 14, preventing the sand screen destruction due to thermal elongation of the pipes 1 (FIGS. 5, 6, 8), 2 (FIG. 5), 3.

The present invention allows for well casing when thermal oil recovery methods are applied, since compensator of thermal pipe elongation is installed in every pipe, which makes it possible to prevent their destruction, as well as reduce installation costs due to exclusion of the sand screen pipe cone expansion operations.

The invention claimed is:

1. Method of well casing for thermal oil recovery, implemented by means of an expandable sand screen which comprises casing a well bore that has been drilled to the top of productive formation with a casing string, drilling through the productive formation with a bit of smaller diameter than that used to drill the bore to the top of the productive formation, running-in the sand screen to the productive formation, creating an excess pressure to the sand screen and tightly connecting it by an anchor with the casing string of the well bore to the top of the productive formation, and subsequent drainage or heat-carrier injection into the formation through the sand screen, wherein the sand screen is pre-assembled of longitudinally-corrugated pipes with slots, mutually connected by end cylindrical portions with a limited longitudinal shift possibility, and the sand screen slots are internally hermetically sealed with a thermoplastic material, and after run-in said excess pressure is applied to the sand screen so that it is expanded along its entire length, except for its cylindrical portions, whereupon a heat carrier is supplied into the sand screen, and thermoplastic material melts, unsealing the slots.

2. An expandable sand screen suitable for implementation of the method of claim 1, including pipes being adapted to provide expansion with slots, an anchor, installed above the sand screen, and a sealing element a wherein said pipes comprise longitudinally-corrugated pipes, and said sealing element comprises a shoe with a valve and allowing creation of an excess pressure after running the screen down into a well, wherein the longitudinally-corrugated pipes and have cylindrical end sections; slots on the bulges of the longitudinally-corrugated pipes are hermetically sealed with a thermoplastic material from inside; the scaling element is executed in form of the end cap installed on the lower pipe of the sand screen; the pipes are connected to each other through a thermal expansion compensator in the form of tail pieces, installed on cylindrical sections of the pipes with a technical collar inbetween and enveloped with a sleeve having two ends, one end of said sleeve being rigidly connected with the end of one of the pipes, and the other connected with the other pipe with a possibility of a limited shift between the pipes.

3. The expandable sand screen according to claim 2, wherein the tail pieces are provided with stoppers, and have cones at the end faces, and manufactured of a harder material, than the technical collar material, which is manufactured in such a way it can be compressed by the end face cones of the tail pieces, when thermal elongation of the screen pipes takes place.

4. The expandable sand screen according to claim 2, wherein the technical collar is provided with an internal circular projection in the middle of its length, and has cones at the ends and is manufactured of harder material than the tail pieces material.

* * * * *